US010905913B2

(12) United States Patent
Yan

(10) Patent No.: US 10,905,913 B2
(45) Date of Patent: Feb. 2, 2021

(54) HAND POWERED TREADMILL

(71) Applicant: Hui Yan, Huntington Beach, CA (US)

(72) Inventor: Hui Yan, Huntington Beach, CA (US)

( * ) Notice: Subject to any disclaimer, the term of this patent is extended or adjusted under 35 U.S.C. 154(b) by 9 days.

(21) Appl. No.: 16/355,856

(22) Filed: Mar. 18, 2019

(65) Prior Publication Data

US 2020/0298043 A1 Sep. 24, 2020

(51) Int. Cl.

| | |
|---|---|
| ***A63B 21/00*** | (2006.01) |
| ***A63B 22/02*** | (2006.01) |
| ***A63B 22/00*** | (2006.01) |
| ***A63B 21/04*** | (2006.01) |
| ***A63B 21/22*** | (2006.01) |

(52) U.S. Cl.

CPC .... *A63B 21/00185* (2013.01); *A63B 21/0435* (2013.01); *A63B 21/157* (2013.01); *A63B 21/22* (2013.01); *A63B 21/4034* (2015.10); *A63B 21/4035* (2015.10); *A63B 22/001* (2013.01); *A63B 22/0005* (2015.10); *A63B 22/02* (2013.01)

(58) Field of Classification Search

CPC .... A63B 22/02–0292; A63B 23/12–16; A63B 21/04–0407; A63B 21/0421; A63B 21/0435; A63B 22/0005

See application file for complete search history.

(56) References Cited

U.S. PATENT DOCUMENTS 4,344,616 A * 8/1982 Ogden ..... A63B 22/0023 482/54
5,207,622 A * 5/1993 Wilkinson ..... A63B 22/0012 482/118
5,460,586 A * 10/1995 Wilkinson ..... A63B 22/0012 482/118
5,492,517 A * 2/1996 Bostic ..... A63B 21/015 482/110
5,527,245 A * 6/1996 Dalebout ..... A63B 21/00072 482/103
5,665,031 A * 9/1997 Hsieh ..... A63B 22/001 482/54
5,688,209 A * 11/1997 Trulaske ..... A63B 21/154 482/54
5,803,874 A * 9/1998 Wilkinson ..... A63B 22/0012 482/51
6,811,517 B1 * 11/2004 Eschenbach ..... A63B 22/001 482/52
6,893,382 B1 5/2005 Moon et al.
2003/0027690 A1 2/2003 Miller
2004/0162191 A1 8/2004 Ercanbrack et al.
2005/0124471 A1 * 6/2005 Wilkinson ..... A63B 21/153 482/121
2006/0068978 A1 3/2006 Moon
(Continued)

OTHER PUBLICATIONS

International Search Report of international application PCT/US2018/041962.

*Primary Examiner* — Jennifer Robertson
(74) *Attorney, Agent, or Firm* — Wang Law Firm, Inc.

(57) ABSTRACT

A novel treadmill has a practical hand-powered system to replace the electric motor for driving the tread belt. The hand-powered system includes fixed range movement of both handles, cranks coupling system for two handles, and a cyclic spring or magnetic energy storage and release system to help pass each handle's dead spot. The handles' pivotal and reciprocal movement can be smoothly and efficiently converted to tread belt movement.

14 Claims, 5 Drawing Sheets

(56) References Cited

U.S. PATENT DOCUMENTS

| | | | | |
|---|---|---|---|---|
| 2010/0144496 | A1* | 6/2010 | Schmidt | A63B 21/4035 482/70 |
| 2015/0238806 | A1* | 8/2015 | Mintz | A63B 22/0012 482/54 |

* cited by examiner

B

C

D

HAND POWERED TREADMILL

FIELD OF THE INVENTION

The present invention relates to fitness equipment, more specifically, relating to treadmills used for walking and running exercise. A new concept treadmill with a hand-powered system to help move a tread belt fitting all needs for running and walking exercise efficiently and safely is disclosed.

BACKGROUND

Current treadmills can be divided into two categories: motorized and non-motorized treadmills (or manual treadmills). For a motorized treadmill, the user needs to adjust the treadmill's speed to the desired speed. The user must walk or run fast or increase the incline of the tread base to gain more intense exercise. For many users, increasing the speed or sharpening the incline may hurt their knees and even jeopardize safety. More than 50 people were killed by treadmill accidents in USA in the last 20 years. There are about 24,000 treadmill accidents sent to emergency rooms in the USA each year. Treadmill injuries constitute 40% of total indoor fitness equipment injuries requiring emergency room treatment.

A non-motorized treadmill requires no external power since it is powered entirely by the user's feet moving the tread belt and the flywheel. In a regular non-motorized treadmill, because the frictional resistance between the tread belt and the foot board's upper surface needs to be overcome by the user, it is difficult to reach the desired speed without significantly increasing the incline of the tread base. In most cases, increasing the incline of the tread base is the only option for producing a higher intensity workout. It is very difficult to reach the anticipated running speed for current non-motorized treadmills, therefore the usage of non-motorized treadmills is significantly limited. Paramount to the challenge of designing a non-motorized treadmill is reaching the desired workout intensity while allowing the operational speed of the treadmill to remain firmly under user control. Much research has been done since treadmills have become popular fitness equipment, but no significant breakthrough has been made so far.

BRIEF SUMMARY OF THE INVENTION

The present invention relates to a novel treadmill with a unique hand-powered system comprising of two handles connected to the drive train in pivotal and reciprocal movement to smoothly transfer the power from the user's hands to the tread belt. In order to generate a smooth and constant drive force, a cyclic energy storing and releasing system and reciprocal handle coupling system with a pair of cranks are used in the drive train. Also, a speed transmission system is used to drive the tread belt to fit the user's pace. Handles will be moved pivotally by push and pull force from a user's hands directly applied on upper ends of both handles. A pair of cranks is used to transfer each handle's pivotal movement into a rotary movement and to couple both handles in reciprocal and opposite movement. Since the handles move slowly in most case, the flywheel does not generate sufficient kinetic energy to pass dead spots, therefore a unique cyclic energy storing and releasing device for passing dead spots of both handles is used in this invention. The present invention is the first practical hand drive treadmill that can fully replace motorized treadmills and can be used for full body exercise with fast calorie burning.

BRIEF DESCRIPTION OF THE DRAWINGS

An embodiment of the present invention is illustrated as example and is not limited by the figures of the accompanying drawings.

DETAILED DESCRIPTION OF THE INVENTION

The present disclosure is to be considered as an embodiment of the present invention, and is not intended to limit the invention to the specific embodiments illustrated by the figures or description below.

Figure 1:
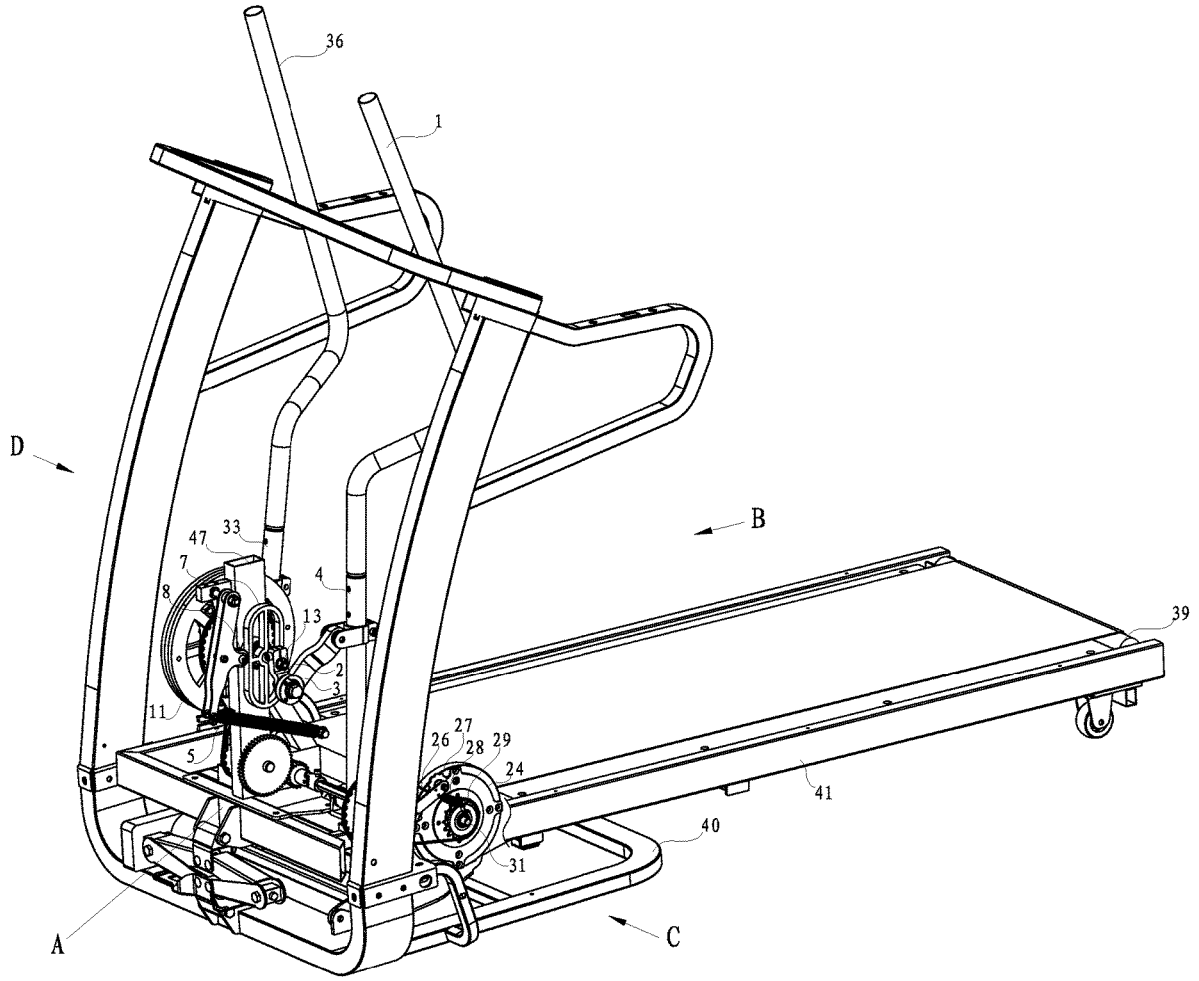
FIG. 1 is a perspective view of the treadmill with reciprocal fixed range movement handles.
Figure 2:
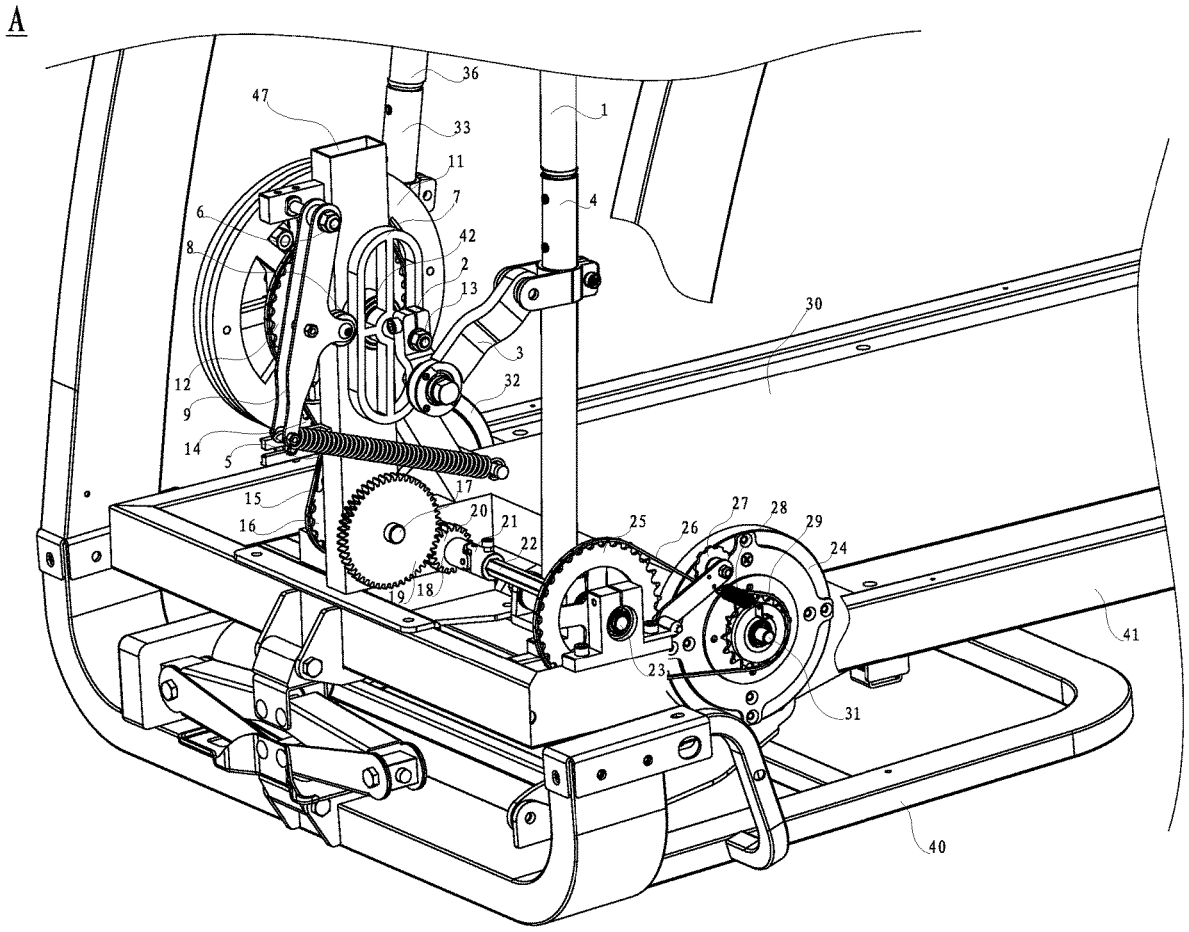
FIG. 2 is an enlargement of a perspective view of the drive train of FIG. 1.
Figure 3:
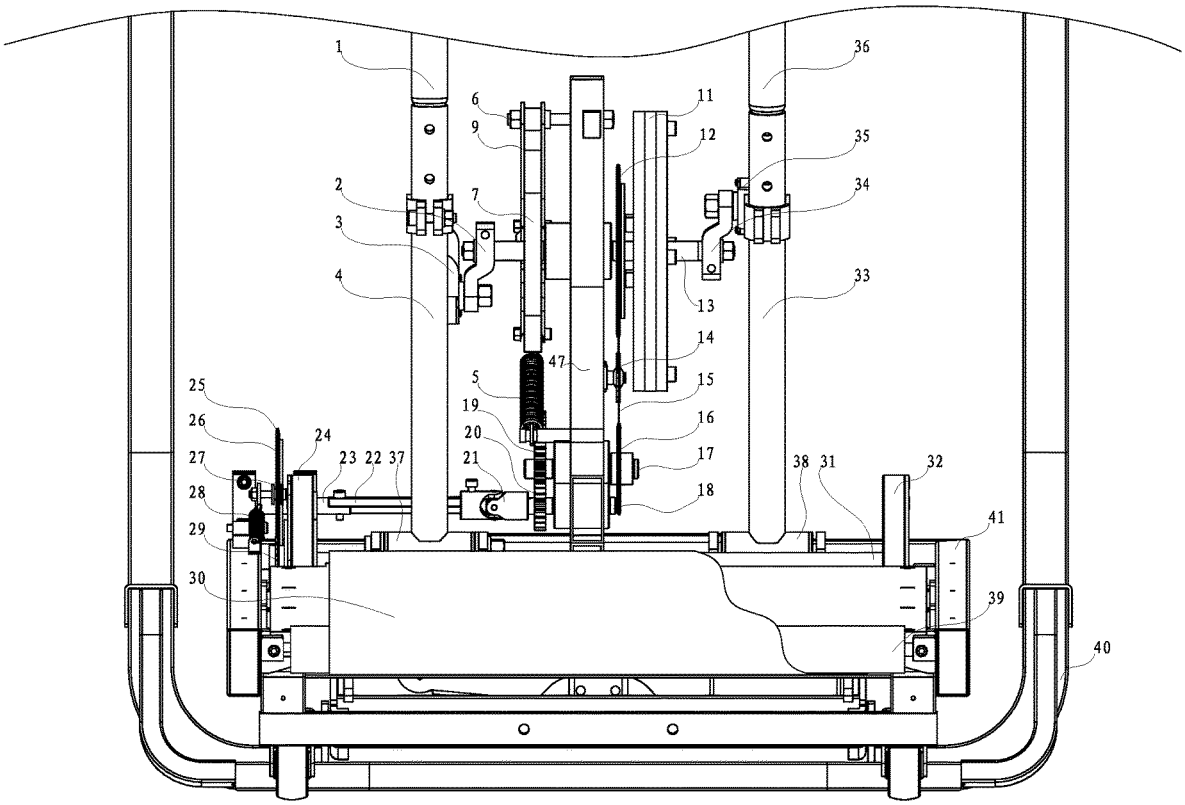
FIG. 3 is a rear view of FIG. 1, View B.
Figure 4:
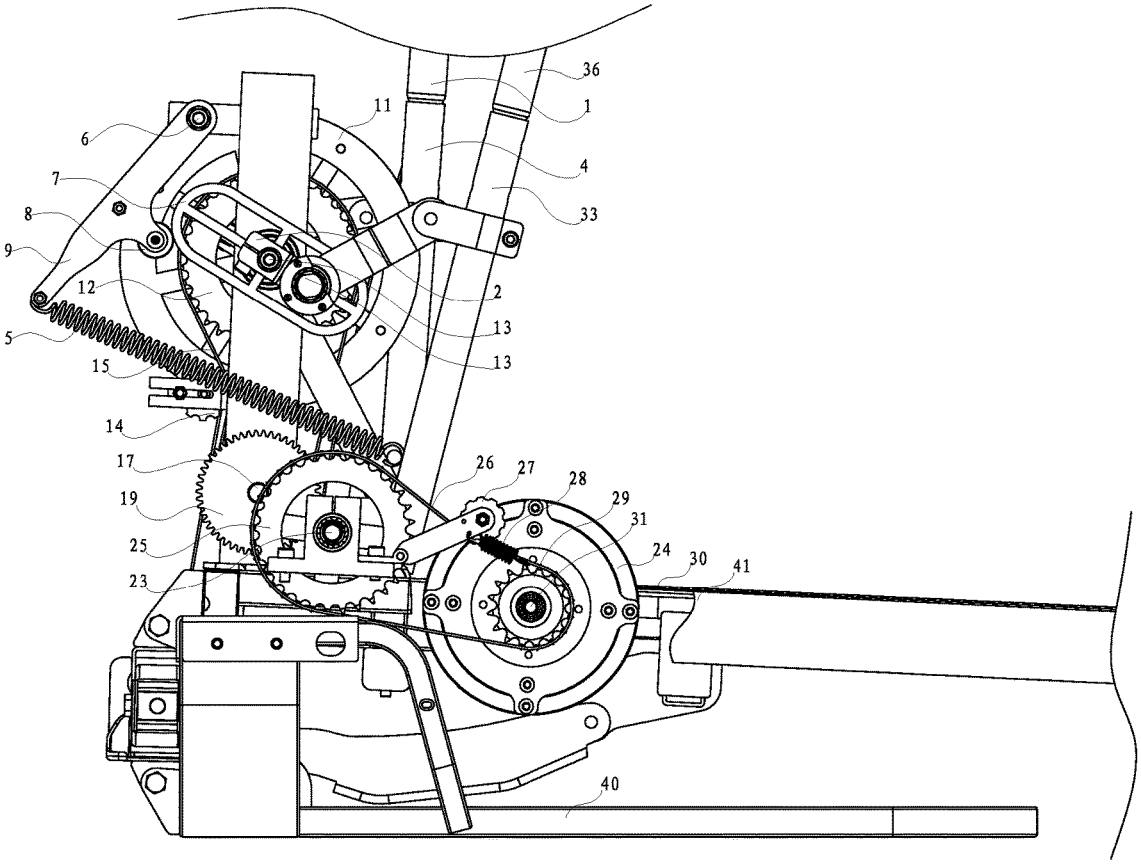
FIG. 4 is a side view of FIG. 1, View C.
Figure 5:
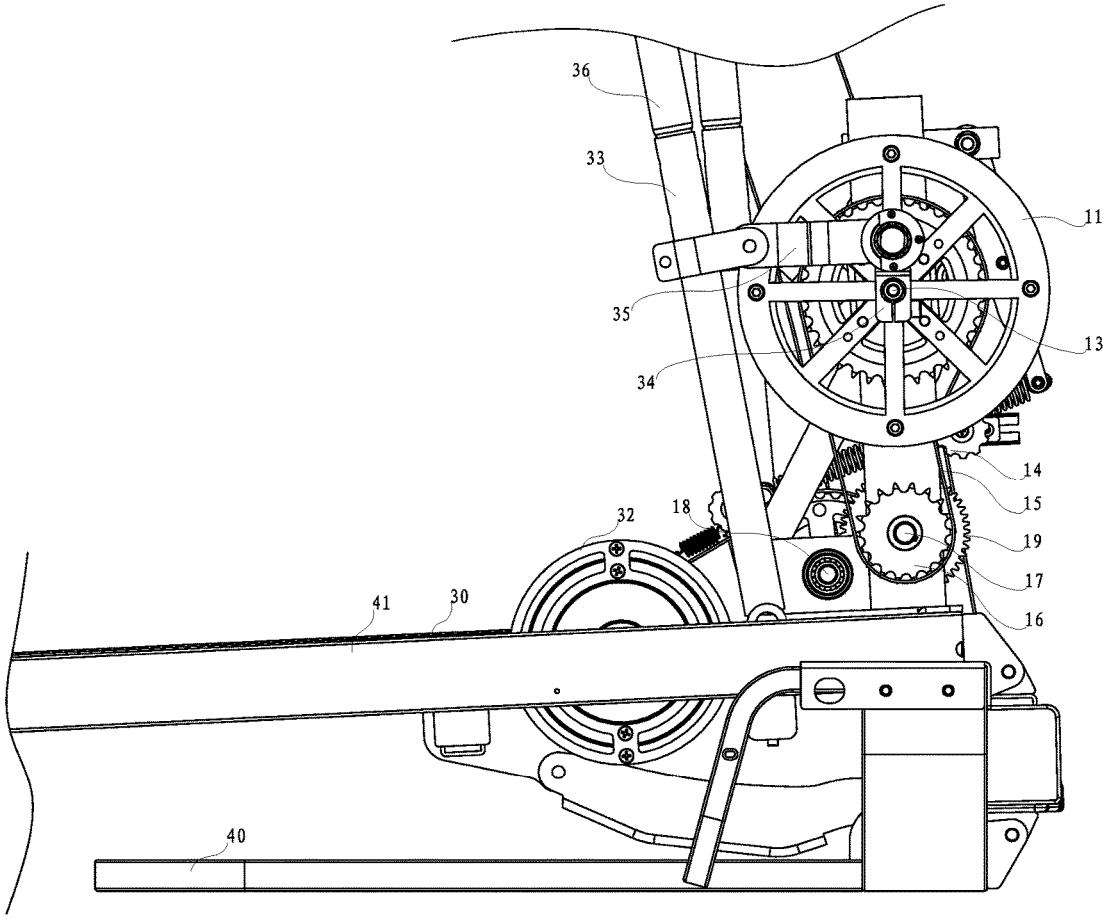
FIG. 5 is a side view of FIG. 1, View D.

FIGS. 1-5 show one embodiment of the treadmill with reciprocal fixed range movement handles. In FIGS. 1-5, the manual treadmill is shown with basic structures such as base 40, foot board frame 41, front tread belt shaft 31, rear tread belt shaft 39, flywheels 24 and 32, and tread belt 30. The hand-powered system includes upper handles 1, 36, lower handles 4, 33, cranks 2, 34, crank connectors 3, 35, the first shaft 13, dead spot overcoming flywheel 11, the first chainwheel 12, the first chain 15, the first tension wheel 14, recovery arm 9 with recovery wheel 8 in the middle, the cam 7 on its axle 13 pushed by the coil spring 5 via recovery wheel 8, the second chainwheel 16 on the second shaft 17, second shaft gear 19 on the second shaft 17, third shaft gear 20 on the third shaft 18, universal joint 21, connector 22, the fourth shaft 23, the third chainwheel 25, the second chain 26, the second tension wheel 27, and freewheeling chainwheel 29 on the front tread belt shaft 31. The coupling system for the two handles and the transmission system between the handles and the tread belt shaft can be called the drive train here. Also, the treadmill frame comprises the treadmill foot board frame 41 and the treadmill base 40.

The lower handles 4 and 33 are connected to the upper handles 1 and 36 respectively. The drive train frame 47 is mounted on the foot board frame 41. The lower ends of the lower handles 4 and 33 are connected to the drive train frame 47 via hinges 37 and 38 respectively. Bearings or other rotational joints can also be used to replace hinges here. The user pushes and pulls each handle 1 and handle 36 alternatively, driving the first shaft 13. However, an overrunning clutch 42 restricts the first shaft 13 to rotate in only one direction regardless of the way that the handles are operated. Cranks 2, 34 and crank connectors 3, 35 are used to connect lower handles 4, 33 to each end of the first shaft 13. The first chain 15 links the first chainwheel 12 to the second chainwheel 16, and further rotates the second shaft 17 to drive the third shaft 18 to rotate opposite the second shaft 17 via the second shaft gear 19 and third shaft gear 20, which are matched together. The universal joint 21 is used to connect the third shaft 18 to the connector 22 and fourth shaft 23. The third chainwheel 25 is connected to the fourth shaft 23. The second chain 26 connects the third chainwheel 25 together with the freewheeling chainwheel 29. The second tension wheel 27 and spring 28 are used to adjust the tightness of the second chain 26. The front tread belt shaft 31 is rotated by the second chain 26 via the freewheeling chainwheel 29. The user's hands power the treadmill's tread belt 30 only if the freewheeling chainwheel 29 rotates faster than the front tread belt shaft 31. If the freewheeling chainwheel 29 does not rotate faster than the front tread belt shaft 31, the tread belt 30 freely rotates without the power input from the handles. The power from the user's hands helps the tread belt 30 move at the desired speed. The freewheeling chainwheel 29 and the overrunning clutch 42 are interchangeable, also the chainwheel and chain of the freewheeling chainwheel 29 can be replaced by a belt wheel and belt here.

FIGS. 1-5 show the hand powered treadmill with reciprocal fixed range handle movement. Each cycle of the handle movement is fixed such that the user needs to push or pull each handle to its maximum range before the user can change the movement direction of the handle. This will rotate the first shaft 13. The user's left-hand pushes handle 1 forwards and causes handle 36 to move backwards and vice versa. Therefore, one hand pushes and the other hand pulls at the same time and then switching direction after passing each handle's dead spot to generate consistent drive force. The overrunning clutch 42 prevents the first shaft 13 from rotating in the wrong direction.

An explanation of the cyclic energy storage and release system is as follows. When the first shaft 13 rotates, the cam 7 will rotate together and push against the recovery wheel 8 to make the recovery arm 9 swing back and forth around the shaft 6. The cam 7 has a symmetric elongated shape with smooth outside surface for the recovery wheel 8 to contact and slide upon. The cam 7 is fixed on the first shaft 13 and rotates with the first shaft 13. The coil spring 5 pulls the recovery arm 9 to make the recovery wheel 8 always push against the cam 7. The restorative spring force generated by the recovery wheel 8 against the cam 7 depends on the distance between the recovery wheel 8 and first shaft 13. The greater the distance, the longer the coil spring 5 stretches, therefore increasing the restorative spring force. When the cam 7 rotates, the recovery wheel 8 will reach the furthest point from the cam 7. After that point is passed, the recovery wheel 8 will assist the cam 7 to rotate by releasing the stored energy from the coil spring 5, therefore driving the handles pass their dead spots. Magnetic or other mechanical or non-mechanical devices that can store and release energy in a similar fashion to the spring can also be used here. At dead spots, the handle driving force on the first shaft 13 is zero. In most settings, the dead spots are where handles 1 and 36 reaches their rearmost or foremost positions, or the points where each handle starts to change its movement direction. The recovery wheel 8 reaches the furthest point from cam 7 a little before the dead spot for most efficiently releasing the stored spring energy to pass the dead spot. The stored energy starts to release a little before the dead spot in each cycle. An auto or manual speed transmission system can also be used in the drive train to change the gear ratio for different running/walking pace and speed. FIGS. 1-5 show the treadmill with a rug endless belt, but this invention can be used on a slat endless belt and any other tread belts.

What is claimed is:

1. A human powered fitness equipment, comprising:
a frame;
a tread belt mounted upon the frame;
a drive train connected to the tread belt, the drive train being connected to a first shaft;
a cyclic energy storage and release system, comprising:
an elongated cam attached to the first shaft, the cam having an outer surface;
a recovery wheel disposed on the outer surface of the cam;
a recovery arm attached to the recovery wheel; and
a coil spring attached to the recovery arm;
a first handle and a second handle for driving the first shaft;
wherein the coil spring is stretched when the first shaft is driven by movement of the first and second handles, exerting a restorative force upon the recovery wheel which is transferred to the first shaft by the cam to pass dead spots.

2. The human powered fitness equipment according to claim 1, wherein the first and the second handles are attached to a first crank and a second crank, respectively, and the first and second handles are coupled in reciprocal movement by the first and second cranks, such that the first handle moving in one direction causes the second handle to move in an opposite direction.

3. The human powered fitness equipment of claim 2, wherein the first and the second handles are pivotally mounted on the frame.

4. The human powered fitness equipment according to claim 1, wherein the cyclic energy storage and release system stores energy from each handle's movement and releases the energy to pass dead spots of each handle's movement.

5. The human powered fitness equipment of claim 1, wherein the drive train comprising:
at least one overrunning clutch which restricts the first shaft to rotate in one direction, the overrunning clutch being fixed on the first shaft adjacent to the cam;
a coupling device to couple the first and the second handles together in reciprocal fixed range movement, wherein reversing movement direction of said first and second handles only can be done after said first and second handles passing a point of maximum movement range.

6. The human powered fitness equipment of claim 1 wherein the drive train is connected to the tread belt by a first chainwheel fixed onto the first shaft, a second chainwheel connected to the first chainwheel by a first chain, a second shaft passes through the second chainwheel, a second shaft gear is attached to the second shaft, the second shaft gear interlaces with a third shaft gear attached to a third shaft, the third shaft being joined to a fourth shaft by a connector, the fourth shaft passing through a third chainwheel, the third chainwheel being connected to a freewheeling chainwheel by a second chain, the freewheeling chainwheel being connected to a front tread belt shaft which drives the tread belt.

7. The human powered fitness equipment of claim 6, wherein the second chain is straddled by a tension wheel which can be moved to adjust how tightly the second chain links the third chainwheel to the freewheeling chainwheel.

8. The human powered fitness equipment of claim 7, wherein the freewheeling chainwheel transfers power generated from the handles to the tread belt only if the freewheeling chainwheel rotates faster than the front tread belt shaft.

9. An apparatus comprising:
a frame;
a first shaft connected to the frame;
a cam mounted on the first shaft;
at least one handle connected to the first shaft;
a recovery arm swingly connected to the frame; and
a spring with one end connected to the recovery arm, wherein the at least one handle moves causing the cam to rotate and the recovery arm to swing away from the first shaft, thus extending the spring.

10. The apparatus of claim 9 further comprising a flywheel connected to the frame, wherein the flywheel rotates with the cam.

11. The apparatus of claim 9, wherein the spring compresses, forces the recovery arm against the cam and assists in rotation of the cam to pass dead spots.

12. The apparatus of claim 9 further comprising a crank connector linking the first shaft to the at least one handle.

13. The apparatus of claim 9, wherein the cam has an elongated shape with a smooth external surface for contacting the recovery arm.

14. The apparatus of claim 9, further comprising a recovery wheel mounted on the recovery arm, wherein when the first shaft rotates, the cam pushes against the recovery wheel to store energy in the spring, and when the cam no longer pushes against the recovery wheel, the spring drives the recovery arm against the cam to release the energy.

* * * * *